United States Patent [19]

Wier

[11] 4,148,114

[45] Apr. 10, 1979

[54] HIGH GRIP PAPER CLIP

[76] Inventor: John P. Wier, 2551 Worden St., San Diego, Calif. 92110

[21] Appl. No.: 940,498

[22] Filed: Sep. 8, 1978

[51] Int. Cl.[2] ..... B42F 1/02; A44B 21/00

[52] U.S. Cl. ..... 24/67.3; 24/67.9; 24/261 F; 24/261 R; 24/262

[58] Field of Search ..... 24/67.3, 67.9, 262, 24/261 R, 261 F

[56] References Cited

U.S. PATENT DOCUMENTS

| | | | |
|---|---|---|---|
| 3,913,181 | 10/1975 | Walker | 24/67.9 |
| 4,055,874 | 11/1977 | Brown | 24/67.3 |

*Primary Examiner*—Bernard A. Gelak

*Attorney, Agent, or Firm*—Brown & Martin

[57] ABSTRACT

A paper clip incorporating metal wire inner and outer loops for strength is encapsulated by a resilient material to increase gripping power. In cross section the encapsulation is generally triangular, forming a gripping face and two ramp faces. The ramp faces reduce the likelihood that extra papers will be inadvertently picked up by the clip.

8 Claims, 5 Drawing Figures

HIGH GRIP PAPER CLIP

BACKGROUND OF THE INVENTION

Many attempts have ben made to supplant the dominance of plain wire paper clips with paper clips of improved performance. Generally the improvements have been to the shape or surface texture of wire clips or have involved the use of different materials, such as plastic, in part for the purpose of increasing the gripping surface. Plain wire paper clips have known deficiencies. While they are typically coated with a rust retardant material, they are still subject to rusting under high humidity conditions. In addition, the gripping force of the conventional clip is limited by several inherent factors including the fact that the plain wire paper clip with its rounded cross-sectional configuration has a very small area of contact with the paper surface. In addition, the considerations of ease of paper insertion, and minimization of paper damage, limits the spring force which can be built into such a conventional clip.

U.S. Pat. No. 3,913,181 represents an attempt to improve the performance of conventional clips by applying a coating to a paper gripping surface. The coating generally conforms to the exterior configuration of the wire and therefore cannot reduce the tendency of the clip to pick up unintended additional papers. Also the paper contact area is not significantly increased, again because of the conformity of the coating to the paper clip surface.

In U.S. Pat. No. 4,055,874, the contact area is increased dramatically but at the expense of considerable additional material and manufacturing complexity. There is no attempt to reduce the likelihood of picking up extra papers.

No prior art paper clip shows recognition of or provides structure to deal successfully with the problem of inadvertently picking up extra papers. The misfiling and other loss that such inadvertently attached papers can cause is of potentially calamitous significance.

It is therefore desirable to have a paper clip with improved gripping performance which at the same time, by its design, reduces the likelihood of extra papers being inadvertently picked up by the clip. Such a clip is particularly desirable where it does not corrode.

SUMMARY OF THE INVENTION

In a conventional metal clip, the wire is bent to define inner and outer loops which lie in gripping planes. It is also possible to manufacture a clip with upper and lower loops that lie directly on top of one another and to configure a clip out of attached straight segments rather than the more conventional curved or linear loops. The invention is equally applicable to all of these configurations of a paper clip and is generally applicable to any clip wherein an elongated member or members lie in two opposed gripping planes.

In an exemplary embodiment of the invention, the deficiencies of prior art paper clips are overcome in a device which does not substantially increase the manufacturing cost or complexity of conventional metal clips. According to the invention, the elongated relatively rigid member is at least partially encapsulated by a resilient material formed with a generally triangular cross section. The base of the triangular cross section forms an enlarged gripping face lying in the respective gripping plane. The gripping faces on opposed loops are in planar opposition so that when the clip is placed over a paper or papers, each gripping face is in contact with a paper surface. The base of the generally triangular configuration is at least twice the height producing two ramp faces which taper down to a point at the plane of contact with the paper. The ramp faces therefore tend to deflect papers which come in contact with the clip when it is installed on a paper or papers. Thus, it is much less likely that papers will become inadvertently attached to the clip. The resilient material may be of a rubber composition, having a generally high coefficient of friction thereby further increasing the gripping force available from the elongated member.

The ends of the elongated member are tapered to a ramp terminus and the coating generally conforms to this shape so that the tendency of the ends to tear the paper as the clip is moved about or removed from the paper is minimized.

It is therefore an object of the invention to provide a new and improved paper clip. The paper clip may be completely encapsulated to reduce rusting and the resulting discoloration of the clamped papers. High gripping strength is obtained with a low tendency to pick up extra papers. The resilient material may be color coded to make the clips useful in separating groups of papers. Damage to the papers on movement or removal of the clip is minimized. Other objects and many attendant advantages of the invention will become apparent upon a reading of the following detailed description together with the drawings, in which like reference numerals refer to like parts throughout and in which:

DETAILED DESCRIPTION OF THE DRAWINGS

Figure 1:
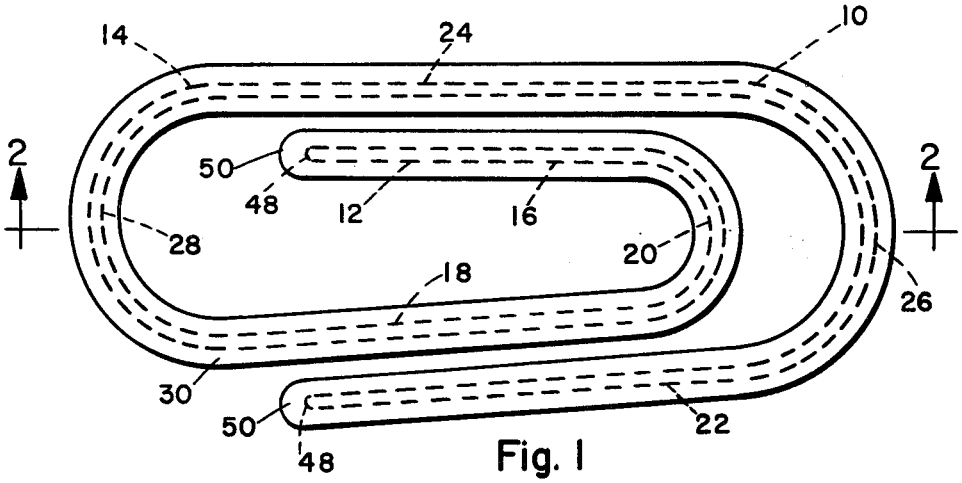
FIG. 1 is a top plan view of the paper clip.
Figure 2:
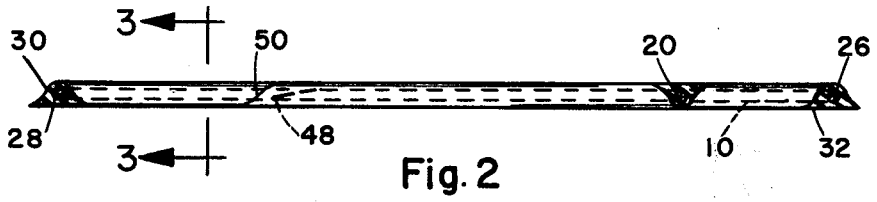
FIG. 2 is a sectional view taken on line 2—2 of FIG. 1.
Figure 5:
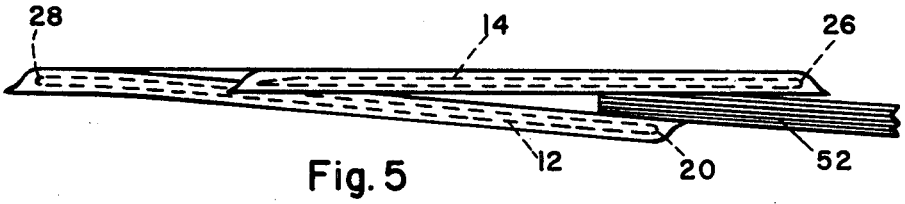
FIG. 5 is a side elevation view showing the gripping action of the clip.

Referring now to the drawings, there is illustrated a paper clip incorporating the features of the invention. The overall configuration of the clip is defined by the shape of the elongated member, which in the illustrated embodiment, is wire with a round cross section. The wire 10 is formed into an inner loop 12 and an outer loop 14. The inner loop 12 comprises a first leg 16 and second leg 18 joined by a curved section 20. The two legs and curved section define a first gripping plane. The outer loop 14 is defined by a first leg 22 and second leg 24. A curved section 26 joins the first and second legs 22 and 24 and a curved section 28 joins the inner loop 12 to the outer loop 14. Legs 22 and 24 and curved section 26 and 28 together define a second gripping plane. As illustrated in FIG. 2, the gripping planes are parallel when the clip is unstressed. However, when the clip is forced onto the paper 52, as is illustrated in FIG. 5, the curved section 26 on the outer loop is forced away from the curved section 20 on the inner loop causing a divergence in the gripping planes.

Figure 3:
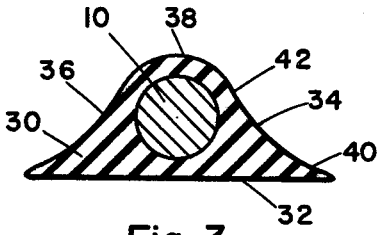
FIG. 3 is an enlarged sectional view taken on line 3—3 of FIG. 2.

The wire legs and curved sections of the inner and outer loops are completely encapsulated by a resilient material in a generally triangular cross section. Referring particularly to FIG. 3, the resilient material 30, in cross section, incorporates a gripping face 32 along the base of the triangular configuration and two sides 34 and 36 forming ramp faces which converge away from the base 32 and toward the wire 10, being joined by a rounded crown section 38 which bridges between the ramp faces 34 and 36, and generally conforms to rounded surface of the wire 10.

The base 32 of the resilient material should be at least twice the height of the generally triangular cross section to improve and obtain the benefits of the invention and base-to-height ratios in excess of 5 are generally undesirable because the resilient material has a tendency to curl away from the paper and therefore increase the tendency to pick up extra papers.

While completely triangular configurations are functional in the practice of the invention, it has been determined that deviation from the straight triangular configuration to the configuration as illustrated maximizes the performance. The initial portion 40 of the exemplary ramp 34 is at a lower angle relative to the base 32 than the terminal portion 42 of the same ramp face. Accordingly, the tendency for the clip to pick up papers unintentionally is further reduced. At the same time the rounded crown 38 produces a smoother transition between the two ramp faces and minimizes the overall height of the clip.

While any resilient material will increase the efficiency of the paper clip by increasing the gripping surface, and reducing the tendency to pick up other papers, it has been determined that a rubber composition has the additional advantage of having sufficient resiliency to maintain contact with the surface of the paper, while at the same time having a relatively high coefficient of friction. Accordingly, its use is preferred. Any resilient material having a coefficient of friction greater than the elongated member will improve the performance of the clip.

Figure 4:
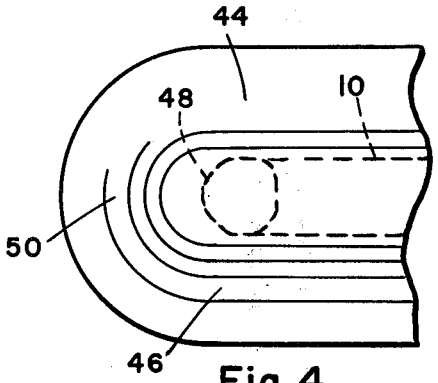
FIG. 4 is an enlarged top plan view of one end of the clip.

Referring particularly to FIG. 4, the terminal configuration of the elongated member is illustrated. The elongated member 10 is terminated by ramp sections 44 and 46 at the end 48 of the wire and the resilient material extends beyond the wire to form a ramp terminus 50. Thus, as the clip is moved on or removed from a clamped paper, the tendency of the elongated member to rip or otherwise mark the paper is reduced or eliminated, both by the shape of the elongated member and its associated resilient material.

Having described my invention, I now claim:

1. A paper clip having a first clamping loop and a second clamping loop, each clamping loop comprising an elongated member formed to define first and second opposed clamping planes, wherein the improvement comprises:

a resilient material secured around said elongated member along at least a portion of each of said clamping loops, said resilient material having a cross-sectional configuration including a generally flat gripping face, said gripping face being parallel to the clamping plane of the respective clamping loop, said cross-sectional configuration further including ramp faces sloping away from said gripping face and toward said elongated member, and said gripping faces on the first clamping loop being in planar opposition to the gripping face of the second clamping loop.

2. The paper clip according to claim 1, wherein:

said resilient material substantially completely encapsulates said elongated member over at least a portion of the length of said elongated member.

3. The paper clip according to claim 1, wherein the elongated member is a wire with a round cross section formed into inner and outer loops and wherein the improvement further comprises:

said ramp faces sloping away from said gripping face and being joined by a rounded crowned surface bridging said ramp faces and conforming to the surface of said wire.

4. The paper clip of claim 1, wherein:

said resilient material comprises a rubber composition.

5. The paper clip according to claim 1, wherein:

said resilient material forms a generally triangular cross section having a base/height ratio greater than 2 and less than 5.

6. The paper clip according to claim 1, wherein the elongated member is metal wire and the improvement further comprises:

said resilient material having a higher coefficient of friction than that of the wire.

7. The paper clip according to claim 6, wherein:

said resilient material completely encapsulates said wire.

8. The paper clip according to claim 3, wherein:

the ends of said wire and the associated resilient material taper in a ramp terminus.

* * * * *